United States Patent [19]

Martin

[11] Patent Number: 4,787,618

[45] Date of Patent: Nov. 29, 1988

[54] SYSTEM FOR FEEDING FLAT SHEETS

[76] Inventor: Guy Martin, 4 rue des Alisiers, 4331 Flemalle, Belgium

[21] Appl. No.: 138,827

[22] Filed: Dec. 28, 1987

[30] Foreign Application Priority Data

Dec. 30, 1986 [LU] Luxembourg ..... 86728

[51] Int. Cl.[4] ..... B65H 3/12

[52] U.S. Cl. ..... 271/94; 271/105; 271/34; 271/258; 414/121

[58] Field of Search ..... 271/95, 96, 90, 94, 271/97, 98, 34, 105, 106, 195, 196, 112, 258; 414/121, 124, 128

[56] References Cited

U.S. PATENT DOCUMENTS 3,774,907 11/1973 Borostyan ..... 271/196 X
4,699,369 10/1987 Zirilli ..... 271/94

FOREIGN PATENT DOCUMENTS 0018578 2/1979 Japan ..... 271/112
0149927 11/1981 Japan ..... 271/90
0184034 11/1982 Japan ..... 271/112
0052429 3/1985 Japan ..... 271/34
0232335 11/1985 Japan ..... 271/90

*Primary Examiner*—Joseph J. Rolla
*Assistant Examiner*—Stephen Parker
*Attorney, Agent, or Firm*—Kramer, Brufsky & Cifelli

[57] ABSTRACT

A movable grill is mounted in a frame in such a way that the grill is capable of being moved a certain distance above a feed table towards an ejection point and a suction device is mounted above the section of the grill which moves towards the ejection point. An air-tight rear sealing skirt is suspended from the frame to enclose the space found between the afore-mentioned section of the grill and the top of a pile of sheets on the feed table; and a forward air-tight sealing skirt is suspended from the aforementioned section of the grill above the ejection point such that the vacuum created by the section means causes eddies of air around the edges of the pile of sheets in such a way that the top sheet of the pile of sheets is caused to vibrate and is drawn up to the section of the grill in order that the top sheet is moved with the grill towards the ejection point.

11 Claims, 4 Drawing Sheets

FIG. 1
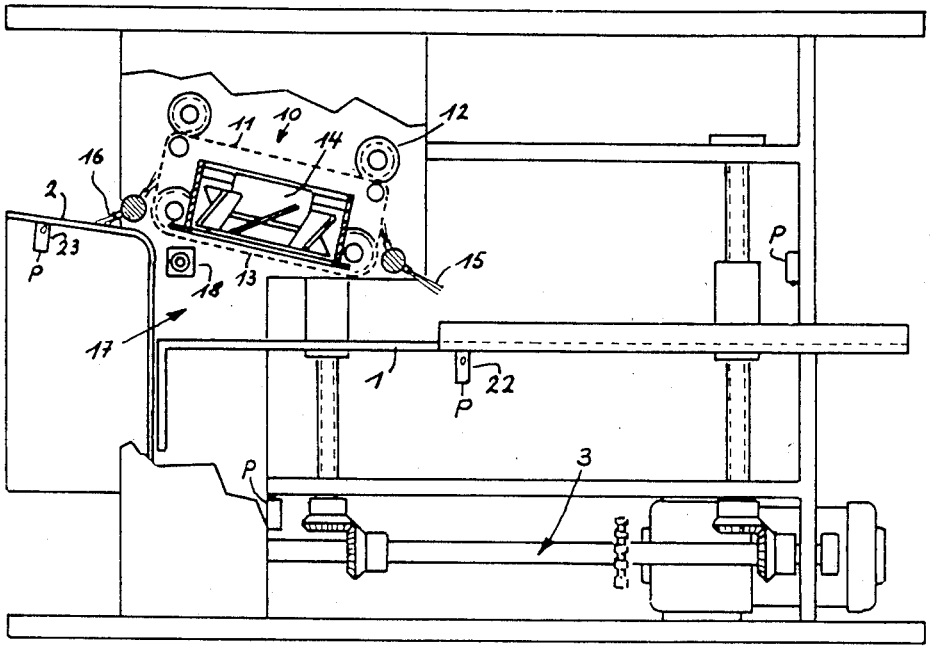
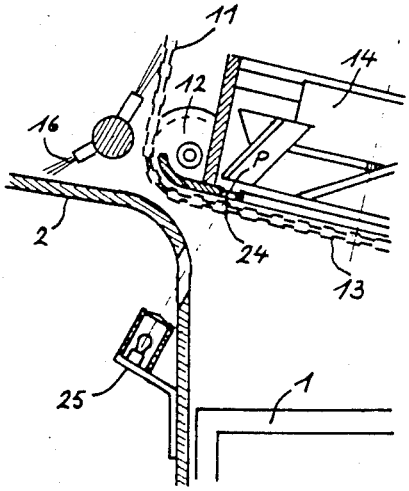
FIG. 2

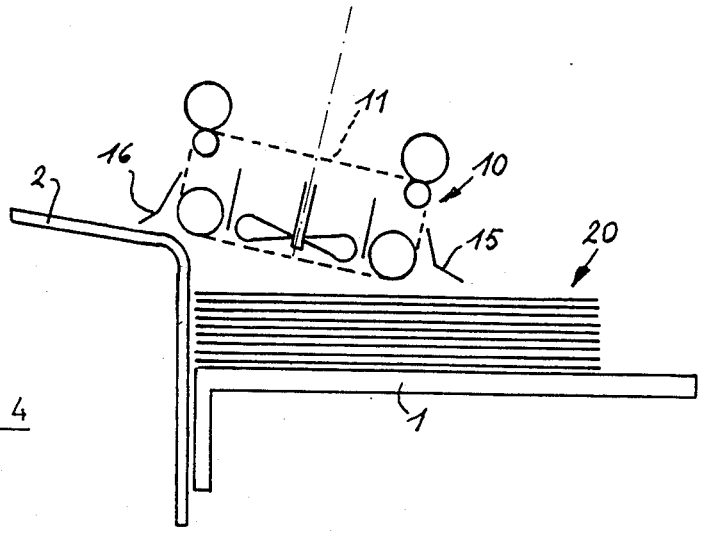
FIG. 4
FIG. 5
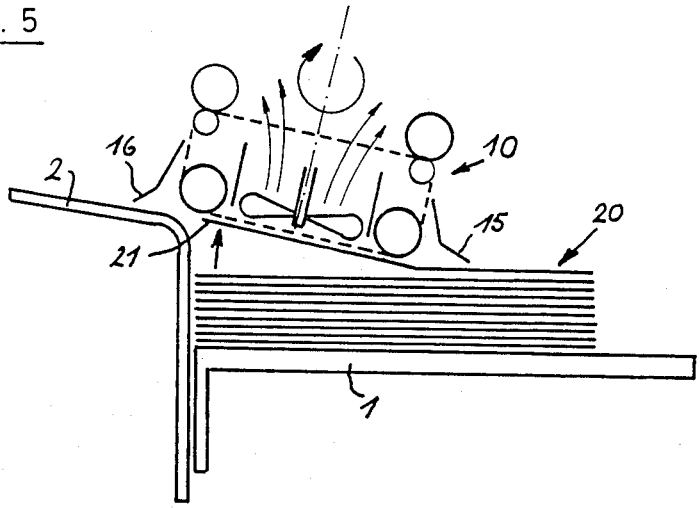

SYSTEM FOR FEEDING FLAT SHEETS

BACKGROUND OF THE INVENTION

The present invention relates to a system for automatic and consistently accurate feeding of flat sheets, for example sheets of paper, from a pile of sheets loaded into a machine which takes those sheets one by one, for instance a collator.

In the market two basic sheet feeding systems exist: suction feed systems and friction feed systems. Suction fed systems perform well, but are costly and space-consuming; furthermore, such systems call for delicate adjustment of air and vacuum and an incorrect feed, such as a double feed, is only detected after the sheets have moved away from the pile, which can frequently cause paper jams and machine stoppages and requires special intervention by the operator. Further, the rubber used in the suction means will dry and perish leading to frequent replacement.

Friction feed systems call for a constant pressure on the sheet by a feeder pad or roller. The adjustment of the pressure is critical and this means that the range of papers that can be handled by friction feed systems is narrow and it is generally not possible to feed very thin and/or delicate papers or very heavy and slippery material.

Whatever their method of feeding, the known systems are all sensitive to the variable parameters of a given pile of sheets to be fed: physical dimensions, weight, density, humidity, a tendency to stick together, static electricity, all of which can vary within the same pile. In particular with sheets of paper, it should be noted that the consumption of paper shows a continuing upward trend in the use of delicate papers such as self-copy paper.

Known friction feed systems are generally incapable of operating with these types of paper and suction feed systems operate with difficulty.

SUMMARY OF THE INVENTION

The main objective of this invention is a feed system capable of accurate and high-speed feeding of flat material sheets of different thickness, type, weight, surface characteristic and dimensions, with a significant reduction in machine stoppages and operator intervention.

A secondary objective achieved by this invention is that the system is of modular type and can easily be installed in many different types of machine.

The above objectives are achieved according to this invention by means of a flat sheet feeding system comprising a movable grill mounted on a frame in such a way that the grill is capable of being moved forward a certain distance above the feed table towards an ejection point; suction means mounted above the section of the grill which moves towards the ejection point, an air-tight rear sealing skirt suspended from the frame to enclose the space found between the aforementioned section of the grill and the top of the pile of sheets on the feed table; and a forward air-tight sealing skirt suspended from the aforementioned section of the grill and the ejection point, such that the vacuum created by said suction means causes eddies of air around the edges of the pile of sheets in such a way that the top sheet of the pile of sheets is caused to vibrate and is drawn up to said section of the grill in order that said top sheet can move with the grill towards the ejection point.

This system uses neither suckers nor any kind of friction feed device, is of simple and compact construction and provides a high degree of accuracy in sheet feeding. The system is not restricted to paper: any flat material can be lifted such as textile, metal or plastic. Further advantages of the invention will become apparent from the following description of an exemplary embodiment.

BRIEF DESCRIPTION OF THE DRAWINGS

FIG. 1 is an elevational view of the system according to the invention complete with feed tray assembly with cut-away.

FIG. 2 is a sectional view in large scale of a detail of FIG. 1.

FIGS. 4, 5 and 6 illustrate three stages in the operation of the feed system according to the invention.

DESCRIPTION OF AN EXEMPLARY EMBODIMENT OF THE INVENTION

Figure 3:
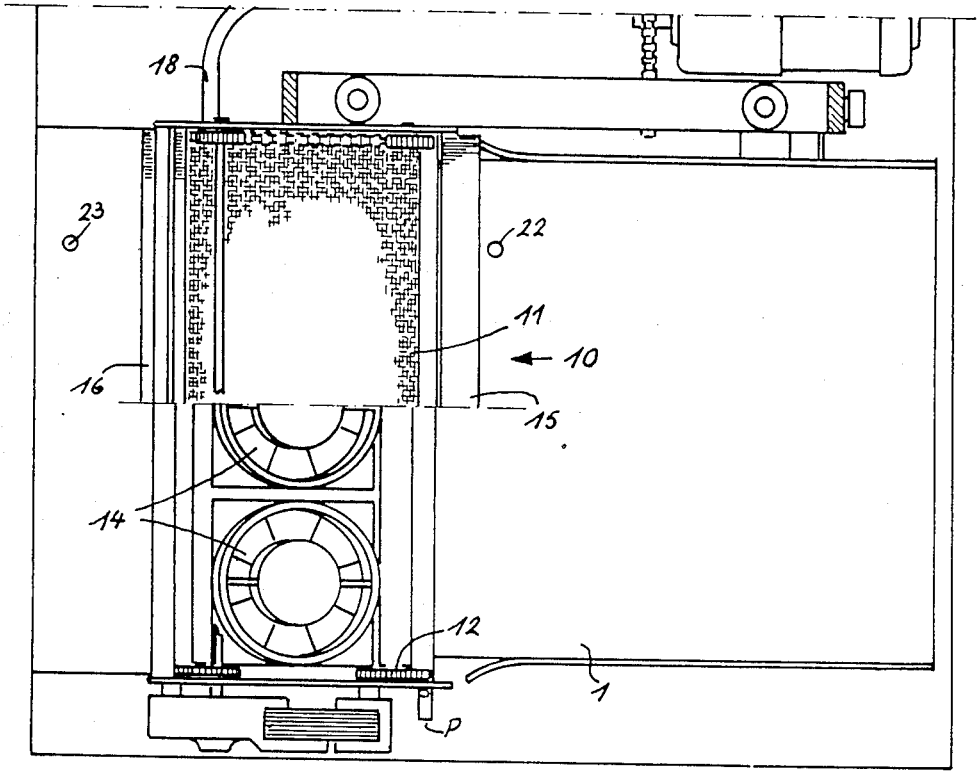
FIG. 3 is a top view of the system with partial cut-away.

In FIGS. 1, 2 and 3 the feed system in accordance with the invention is labelled 10. This system is connected to a feeding table 1 which is loaded with a pile of sheets from which sheets will be fed one by one to the ejection point 2 where the sheets taken from table 1 may undergo a further process. The paper feed table 1 is mounted on a mechanism 3 which moves the feed table vertically to maintain the top of the pile at a constant distance from the feed unit 10. Alternatively, the feed unit 10 can itself be moved vertically in relation to the feed table 1 which would then be fixed in a constant position. The feed system according to the invention uses a perforated grill 11 mounted on a frame which moves by way of a drive mechanism principally by means of the toothed wheels 12.

In the embodiment shown, the grill 11 is endless and joined on itself and incorporates a section 13 which moves a pre-determined distance above the feed table 1 towards the ejection point 2. Above the grill area 13 a suction device 14 is mounted comprising in this case three fans which are shown in FIG. 2. The system is completed by a rear air-tight sealing skirt 15 suspended so that it rests lightly on top of any pile of sheets placed on the feed table 1, and a forward air-tight sealing skirt 16 hanging above the ejection point 2. These air-tight sealing skirts run the full width of the unit perpendicular to the movement of the grill 13 and their function is to close off the free space 17 between the grill assembly 13 and the feed table 1 during the feeding cycle of the system described hereafter.

The feeding cycle of the sheet feeding system is described hereafter and is shown particularly in FIGS. 4 to 7. A pile of flat sheets 20 is placed on the feed table 1, the rear air-tight sealing skirt 15 comes to rest on the pile 20 (FIG. 4). It is seen that the space 17 is closed on the two transverse sides by the air-tight sealing skirts 15 and 16. In FIG. 4 and the following illustrations, the fans 14 are represented schematically by a helix.

To operate the system, the fans are switched on. This creates a flow of air in the space 17, the flow of air in the aforementioned space entering by the open lateral sides as shown in FIG. 7: the arrows labelled "F" represent the air-flow blown on a lateral side of the system. A similar air-flow is generated on the other side. As a result of the action of these lateral air-flows, the upper sheets of the pile 20 begin to vibrate and the top sheet labelled 21 in FIG. 5 lifts, comes into contact with the grill 11 and remains stuck to that grill 11 by the vacuum across the grill 11. This sheet is then pulled by the grill 11 when the grill 11 is caused to move and is guided towards the ejection point 2 (FIG. 6) whilst the next sheet 26 is sucked against the grill 11. The sheets are thus found to be picked up one by one and sent in succession towards the ejection point 2.

Figure 6:
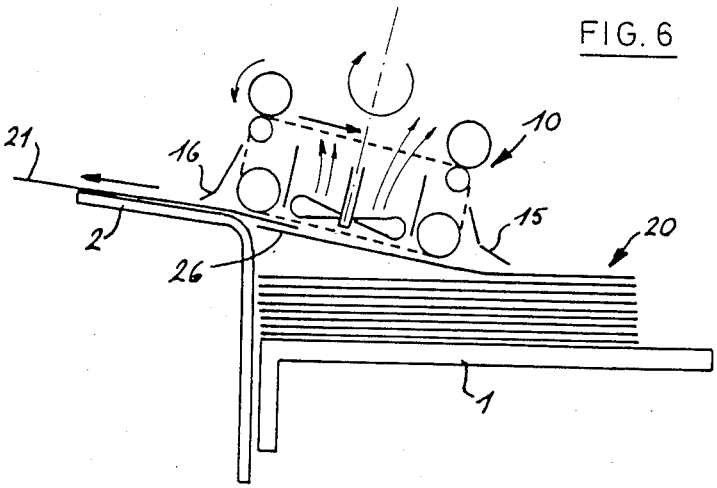
Figure 7:
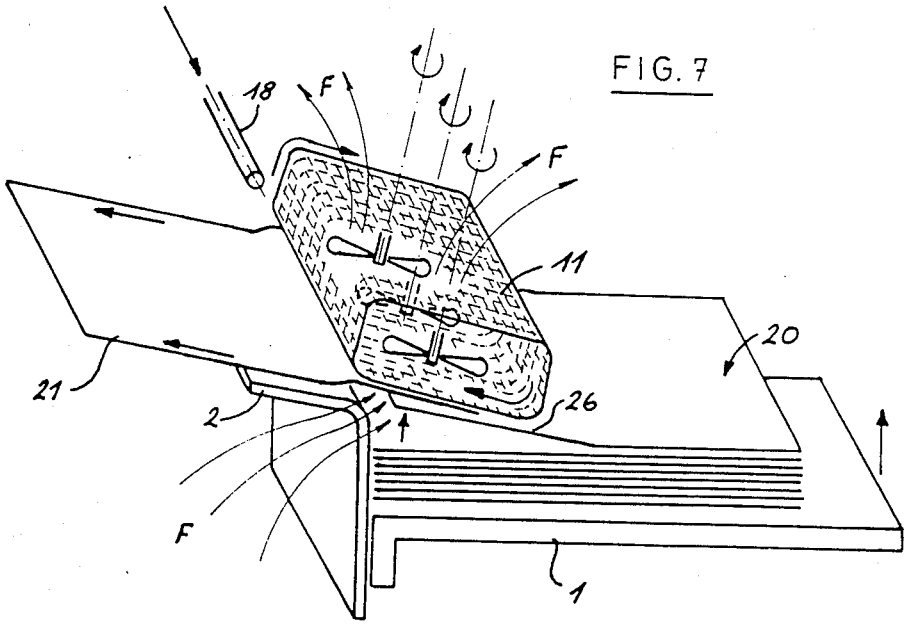
FIG. 7 is a perspective view showing the air-flow created in the feed system of the invention.

It is seen in FIG. 6 that the sheet 21 in its trajectory towards the ejection point 2 closes the exit aperture and reproduces the effect of the forward air-tight sealing skirt 16, so that the vacuum effect is constantly maintained in space 17 until the exhaustion of the pile 20, unless a stop is commanded by the control system in which case the forward air-tight sealing skirt 16 maintains a seal across the free space (17). The control system will be outlined later herein.

It has already been said that the relative distance between the lower side of the grill 11 and the top of the pile of sheets 20 is kept constant as the height of the pile of sheets diminishes.

The simplicity and compactness of the sheet feeding system according to the invention, which uses neither suckers nor rollers, nor feeder pads, allows for a modular construction that is multi-purpose, versatile and reliable.

The feed system described above can also incorporate supplementary pneumatic devices to introduce air into the pile of sheets 20 in case the sheets stick together or in case the upper sheet does not detach itself from the pile and is therefore not drawn up to the grill within a specified time. These supplementary pneumatic devices can comprise a fan or fans or an air-jet or jets to blow pulses of air at one or more sides of the pile of sheets. FIGS. 1 and 3 show an example of an additional air-jet 18 which directs a pulse of air at the side of the pile. Control of all the devices and their functions can be integrated in the general automatic controls of the system under the supervision of detectors controlled by a processor which can be incorporated in the machine. In FIGS. 1–3 there are symbolically represented detectors 22, 23 and 24 which check and control the operation of the feed system according to the invention. The connections between the detection cells and the control processor are symbolised by the letter "P". Specifically, the detector 22 serves to detect the presence or absence of sheets on the paper feed tray 1, and the detector 23 serves to detect and control the passage of the sheets one by one through the ejection point 2.

The detector 24 in FIG. 2 represents one or more cells working in concert with one or more beams of light so that the source 25 serves to detect an anomaly on the grill: eg, the presence of a number of sheets stuck together, a torn or folded sheet, a sheet of incorrect thickness, a wrongly printed sheet or no sheet at all.

As stated above the detection devices as well as the operational controls of the system are best incorporated in a processor which governs the actual operation and timing of the whole machine. The programming is capable of inter-active commands controlling, for example and non-exclusively, the turning on, the turning off and the speed of the fans 14, the forward movement of the grill 11, the maintenance of a constant distance between the lower section 13 of the grill and the top of the paper pile 20 on the feed table 1 based on data received constantly from the various detection devices. The processor is programmed to allow for constant and immediate detection of any anomaly on the sheet drawn towards the grill so that the forward motion of the grill is stopped and palliative action taken prior to re-checking and sending the sheet forward to the ejection point. The accuracy of the overall system is thus perfected.

It must be stated again that the feed system in accordance with the invention allows feeding of a wide variety of flat sheets of material including thin and delicate pieces of paper, whether flat or folded and also sheets of fabric and plastic material for example.

Obviously, the exemplary embodiment described in the foregoing and illustrated in the appended drawings is only one of the ways of embodying the concept of the invention; for example, the ejection point need not necessarily be fixed to a machine: the system in modular form can be used as a sheet feeder offered up to or connected with many other kinds of machine which need to be presented with one or a sequence of sheets for further processing.

What is claimed is:

1. A system for feeding flat sheets of material one by one from a pile of sheets placed on a feed table (1), comprising a movable grill (11) mounted on a frame in such a way that the grill (11) is capable of being moved forward a certain distance (13) above the feed table (1) towards an ejection point (2); suction means (14) mounted above a section (13) of the grill which moves towards the ejection point (2), an air-tight rear sealing skirt (15) suspended from the frame and in contact with the section (13) of the grill and the top of the pile of sheets (20) on the feed table (1); and a forward air-tight sealing skirt (16) in contact with the section (13) of the grill and the ejection point (2), such that the vacuum created by said suction means (14) causes eddies of air around the edges of the pile of sheets (20) in such a way that the top sheet (21) of the pile of sheets is caused to vibrate and is drawn up to said section (13) of the grill in order that said top sheet (21) can move with the grill towards the ejection point (2).

2. A system according to claim 1, wherein the grill (11) is endless and joined on itself.

3. A system according to claim 1, wherein said suction means (14) is comprised of one or more fans spaced along the transverse width of the grill (11).

4. A system according to claim 1, further comprising means (18) for directing a jet of air at at least one side of the pile of sheets.

5. A system according to claim 1, further comprising detection means (24) placed adjacent or nearby the said section (13) of the grill to check and verify the nature of the sheets (21) drawn one by one towards the ejection point (2) and to detect and signal any anomaly or absence of material.

6. A system according to claim 2, wherein said suction means (14) is comprised of one or more fans spaced along the transverse width of the grill (11).

7. A system according to claim 2, further comprising means (18) for directing a jet of air at at least one side of the pile of sheets.

8. A system according to claim 3, further comprising means (18) for directing a jet of air at at least one side of the pile of sheets.

9. A system according to claim 2, further comprising detection means (24) placed adjacent or nearby the said section (13) of the grill to check and verify the nature of the sheets (21) drawn one by one towards the ejection point (2) and to detect and signal any anomaly or absence of material.

10. A system according to claim 3, further comprising detection means (24) placed adjacent or nearby the said section (13) of the grill to check and verify the nature of the sheets (21) drawn one by one towards the ejection point (2) and to detect and signal any anomaly or absence of material.

11. A system according to claim 4, further comprising detection means (24) placed adjacent or nearby the said section (13) of the grill to check and verify the nature of the sheets (21) drawn one by one towards the ejection point (2) and to detect and signal any anomaly or absence of material.

* * * * *